US009290868B2

(12) United States Patent
Iwata et al.

(10) Patent No.: US 9,290,868 B2
(45) Date of Patent: Mar. 22, 2016

(54) BIODEGRADABLE NONWOVEN FABRIC AND FIBER PRODUCT USING THE SAME

(75) Inventors: Junji Iwata, Shiga (JP); Yasushi Matsuda, Shiga (JP); Mitsuru Kojima, Shiga (JP)

(73) Assignees: JNC Corporation, Tokyo (JP); CHISSO POLYPRO FIBER COMPANY LIMITED, Tokyo (JP)

( * ) Notice: Subject to any disclaimer, the term of this patent is extended or adjusted under 35 U.S.C. 154(b) by 184 days.

(21) Appl. No.: 13/257,090

(22) PCT Filed: Apr. 23, 2010

(86) PCT No.: PCT/JP2010/002941

§ 371 (c)(1),
(2), (4) Date: Dec. 1, 2011

(87) PCT Pub. No.: WO2010/122806

PCT Pub. Date: Oct. 28, 2010

(65) Prior Publication Data

US 2012/0064789 A1 Mar. 15, 2012

(30) Foreign Application Priority Data

Apr. 24, 2009 (JP) ..... 2009-106234

(51) Int. Cl.

| | |
|---|---|
| ***D04H 1/541*** | (2012.01) |
| ***D04H 1/4382*** | (2012.01) |
| ***D04H 1/42*** | (2012.01) |
| ***D04H 3/153*** | (2012.01) |

(52) U.S. Cl.

CPC ..... *D04H 1/541* (2013.01); *D04H 1/42* (2013.01); *D04H 1/4382* (2013.01); *D04H 3/153* (2013.01); *Y10T 442/3707* (2015.04); *Y10T 442/494* (2015.04); *Y10T 442/659* (2015.04); *Y10T 442/68* (2015.04); *Y10T 442/681* (2015.04); *Y10T 442/696* (2015.04); *Y10T 442/697* (2015.04)

(58) Field of Classification Search

CPC ..... B32B 2250/20; B32B 2262/0276; B32B 2262/12; B32B 2307/7163; B32B 5/022; B32B 5/08; B32B 5/26; C08J 2367/02; C08J 2367/04; C08J 3/005; A61L 15/62; D04H 1/42; D04H 1/541; D04H 3/153; D04H 1/147; D04H 1/10; D04H 1/4326; D04H 1/435; D04H 1/55; D04H 1/56; D04H 1/70; D04H 1/72; D04H 1/736; D04H 3/011; D04H 3/147; D01F 6/92; D01F 6/62; D01F 6/625

USPC ..... 442/327, 361–365, 400, 401, 403, 409, 442/411, 415; 428/364–374

See application file for complete search history.

(56) References Cited

U.S. PATENT DOCUMENTS

| | | | | |
|---|---|---|---|---|
| 6,475,418 | B1 | 11/2002 | Tsai et al. | |
| 7,265,188 | B2 * | 9/2007 | Autran | 525/439 |
| 2004/0166758 | A1 * | 8/2004 | Reichmann et al. | 442/400 |
| 2008/0287026 | A1 | 11/2008 | Chakravarty et al. | |

FOREIGN PATENT DOCUMENTS

| | | |
|---|---|---|
| WO | 2007/117235 | 10/2007 |

OTHER PUBLICATIONS

International Search Report issued Sep. 23, 2010, in International (PCT) Application No. PCT/JP2010/002941.

Written Opinion of the International Searching Authority issued Sep. 23, 2010, in International (PCT) Application No. PCT/JP2010/002941.

* cited by examiner

*Primary Examiner* — Jennifer A Steele

(74) *Attorney, Agent, or Firm* — Wenderoth, Lind & Ponack, L.L.P.

(57) ABSTRACT

A nonwoven fabric is provided that has biodegradability and has excellent mechanical strength and excellent texture in combination, and a fiber product containing the nonwoven fabric is provided. The biodegradable nonwoven fabric contains at least two kinds of fibers including a fiber A and a fiber B, in which the fiber A contains a first component having biodegradability, and the fiber B contains a second component having biodegradability. The nonwoven fabric contains a mixed fiber web having a mixing ratio (weight ratio) of the fiber A and the fiber B in a range of from 5/95 to 95/5. The first component contains at least one member selected from the group consisting of an aliphatic polyester and an aliphatic polyester copolymer each having a melting point that is higher than a melting point of the second component. A half crystallization time at 85 degree Celsius of the second component is longer than a half crystallization time at 85 degree Celsius of the first component.

8 Claims, No Drawings

BIODEGRADABLE NONWOVEN FABRIC AND FIBER PRODUCT USING THE SAME

TECHNICAL FIELD

The present invention relates to a nonwoven fabric and a fiber product using the same. More specifically, the invention relates to a nonwoven fabric that is formed of a biodegradable resin and has excellent mechanical strength and excellent texture in combination, and also relates to a fiber product using the nonwoven fabric.

BACKGROUND ART

In recent years, a biodegradable resin is earnestly investigated in the field of fibers and nonwoven fabrics since a biodegradable resin is decomposed into carbon dioxide and water in a short period of time with microorganisms or the like by burying it in the soil, thereby providing less environmental load as compared to the conventional plastic products.

In particular, a biodegradable nonwoven fabric formed of an aliphatic polyester, such as polylactic acid, polyethylene succinate, polybutylene succinate and poly-caprolactone, has properties as nonwoven fabric that are equivalent to those of versatile synthetic fibers and is being subjected to practical use. Polylactic acid has a relatively high melting point among the biodegradable aliphatic polyesters and has high practical utility, and therefore, polylactic acid is expected to be applied to various purposes.

A nonwoven fabric formed of polylactic acid has biodegradability and is excellent in heat resistance owing to the melting point that is generally higher than other aliphatic polyesters. However, a polylactic acid resin has a small crystallization speed under ordinary spinning conditions although it has good crystallinity. Accordingly, fibers having been spun and cooled still have tackiness among the fibers in the web accumulation process, and fibers constituting the web are bonded to each other to provide a nonwoven fabric that lacks flexibility, which is difficult to apply to such a purpose that the nonwoven fabric is in contact with the human skin.

When a web formed of polylactic acid is thermally bonded or resin-bonded with an adhesive while controlling to prevent the flexibility from being impaired, the resulting nonwoven fabric becomes fluffy or inferior in mechanical strength, thereby failing to provide a nonwoven fabric that can be subjected to practical use.

Such a polylactic acid continuous fiber nonwoven fabric is proposed that the polylactic acid polymer constituting the continuous fibers is a polymer or a blend of polymers each having a melting point of 100 degree Celsius or more selected from poly(L-lactic acid), a copolymer of D-lactic acid and L-lactic acid, and a copolymer of D-lactic acid and a hydrocarboxylic acid, and a copolymer of L-lactic acid and a hydrocarboxylic acid and the continuous fibers constituted by the polylactic acid polymer are partially heat-adhered under pressure (see, for example, Japanese Patent No. 3,434,628). However, the nonwoven fabric is constituted by a single component and thus has hard texture with poor flexibility.

Heat-fusible composite fibers formed of two kinds of polylactic acid polymers having different melting points are proposed (see, for example, JP-A-7-310236). The composite fibers are excellent in adhesion property, but the low melting point component functions as an adhesive component for all the fibers, and therefore, a nonwoven fabric produced from the fibers has hard texture with poor flexibility, as similar to a nonwoven fabric constituted by a single component.

CITATION LIST

Patent Literature

[PLT 1] Japanese Patent No. 3,434,628
[PLT 2] Japanese Tokkyo Kokai Koho JP-A-7-310236

SUMMARY OF INVENTION

Technical Problems

An object of the invention is to provide a nonwoven fabric that has biodegradability, and has excellent mechanical strength and excellent texture in combination, and also to provide a fiber product using the nonwoven fabric.

Solution to Problems

As a result of earnest investigations made by the inventors for solving the problems, it has been found that a mixed fiber nonwoven fabric obtained by mixed-fiber spinning of a particular biodegradable resin solves the problems, and thus the invention has been completed based on the finding.

The invention includes the following aspects.

(1) A biodegradable nonwoven fabric containing at least two kinds of fibers including a fiber A and a fiber B, the fiber A containing a first component having biodegradability, and the fiber B containing a second component having biodegradability, (a) the nonwoven fabric containing a mixed fiber web having a mixing ratio (weight ratio) of the fiber A and the fiber B in a range of from 5/95 to 95/5, (b) the first component containing at least one member selected from the group consisting of an aliphatic polyester and an aliphatic polyester copolymer each having a melting point that is higher than a melting point of the second component, and (c) a half crystallization time at 85 degree Celsius of the second component being longer than a half crystallization time at 85 degree Celsius of the first component.

(2) The biodegradable nonwoven fabric according to the item (1), wherein the half crystallization time at 85 degree Celsius of the second component is longer than the half crystallization time at 85 degree Celsius of the first component by 80 seconds or more.

(3) The biodegradable nonwoven fabric according to the item (1), wherein the half crystallization time at 85 degree Celsius of the second component is 180 seconds or more, and the half crystallization time at 85 degree Celsius of the first component is 100 seconds or less.

(4) The biodegradable nonwoven fabric according to one of the items (1) to (3), wherein the half crystallization time at 85 degree Celsius of the first component is 60 seconds or less.

(5) The biodegradable nonwoven fabric according to one of the items (1) to (4), wherein the first component contains at least one member selected from the group consisting of polylactic acid and a polylactic acid copolymer, and the second component contains at least one member selected from the group consisting of poly-butylene succinate and a polybutylene succinate copolymer.

(6) The biodegradable nonwoven fabric according to the item (1), wherein the first component has a melting point that is higher than a melting point of the second component by 40 degree Celsius or more.

(7) The biodegradable nonwoven fabric according to one of the items (1) to (6), wherein the biodegradable nonwoven fabric is a continuous fiber nonwoven fabric produced by a spunbond method.

(8) The biodegradable nonwoven fabric according to one of the items (1) to (6), wherein the biodegradable nonwoven fabric is a continuous fiber nonwoven fabric produced by a melt-blown method.

(9) A composite nonwoven fabric containing the biodegradable nonwoven fabric according to one of the items (1) to (8), and at least one member selected from the group consisting of a nonwoven fabric other than the biodegradable nonwoven fabric, a film, a web, a woven fabric, a knitted fabric and a tow, that is laminated on the biodegradable nonwoven fabric.

(10) A fiber product containing the biodegradable nonwoven fabric according to one of the items (1) to (8) or the composite nonwoven fabric according to the item (9).

Advantageous Effect of Invention

The biodegradable nonwoven fabric according to the invention has biodegradability, and has excellent mechanical strength and excellent texture in combination. Accordingly, the biodegradable nonwoven fabric is favorably applied to an environmentally responsible fiber product, such as a disposable diaper, a clothing, a civil engineering sheet and a filter.

The invention will be described in detail with reference to specific embodiments.

The first component of the invention is at least one member selected from the group consisting of an aliphatic polyester and an aliphatic polyester copolymer each having a melting point that is higher than a melting point of the second component. Furthermore, for providing a biodegradable nonwoven fabric having mechanical strength and excellent texture in combination in the production process of the biodegradable nonwoven fabric of the invention, the half crystallization time at 85 degree Celsius of the second component is necessarily longer than the half crystallization time at 85 degree Celsius of the first component (the reason for which will be described later, and hereinafter, the half crystallization time at 85 degree Celsius may be referred simply to as a half crystallization time). For example, the nonwoven fabric may be designed in such a manner that the half crystallization time of the second component is longer than the half crystallization time of the first component by 80 seconds or more, and for another example, the nonwoven fabric may be designed in such a manner that the half crystallization time of the second component is 180 seconds or more, and the half crystallization time of the first component is 100 seconds or less. The first and second components that satisfy the conditions can be easily selected from the commercially available biodegradable resins. The half crystallization time of the components can be measured by the method described later for Examples.

The first component of the invention may be at least one member selected from the group consisting of an aliphatic polyester and an aliphatic polyester copolymer each having a melting point that is higher than a melting point of the second component. Examples of the aliphatic polyester include a polyglycolic acid, such as polylactic acid (which may be referred to as polylactide) and poly(a-hydroxyacid), a poly (w-hydroxyalkanoate), such as poly(e-caprolactone) and poly(b-propiolactone), poly-3-hydroxypropionate, poly-3-hydroxybutyrate, poly-3-hydroxycaprate, poly-3-hydroxyheptanoate and poly-3-hydroxyoctanoate.

The aliphatic polyester copolymer used as the first component is not particularly limited, and a polymer obtained by copolymerizing from 1 to 10% by mol of lactic acid with a polyalkylene succinate may be used. Examples of the polyalkylene succinate include a copolymer of an alkyldiol, such as ethylene glycol and butanediol, with succinic acid, such as ethylene succinate and butylene succinate.

The aliphatic polyester copolymer used as the first component may also be a polycondensation polymer of glycol and a dicarboxylic acid. Specific examples thereof include polyethylene oxalate, polyethylene succinate, polyethylene adipate, polyethylene azelate, polybutylene oxalate, polybutylene succinate, polybutylene sebacate, polyhexamethylene sebacate, polyneopentyl oxalate and copolymers thereof.

The aliphatic polyester copolymer used as the first component may also be a polycondensation polymer of the aforementioned aliphatic polyester and an aliphatic polyamide, such as an aliphatic polyester amide copolymer. Specific examples thereof include polycaproamide (nylon 6), polytetramethylene adipamide (nylon 46), polyhexamethylene adipamide (nylon 66), polyundecamide (nylon 11) and polylaurylamide adipamide (nylon 12).

Among the aliphatic polyesters and the aliphatic polyester copolymers used as the first component, polylactic acid is most preferably used.

In the case where polylactic acid is used as the first component of the invention, it is preferred that a resin composition containing a mixture of a sugar alcohol and/or a benzoic acid compound is further used in a particular proportion for enhancing the mechanical strength, such as the tear strength and the tensile strength and elongation, of the resulting biodegradable nonwoven fabric.

Examples of the sugar alcohol mixed with the polylactic acid include a linear polyol obtained by reducing a sugar, and a linear polyol having from 3 to 6 carbon atoms is particularly preferred. Specific examples of the sugar alcohol mixed with the polylactic acid include glycerin, erythritol, xylitol, mannitol and sorbitol. Among these, sorbitol is most preferred from the standpoint of plasticization efficiency of the polylactic acid, involatility of the sugar alcohol itself, and the like. The mixing ratio of the sugar alcohol is generally from 0.5 to 5 parts by weight, and preferably from 1 to 3 parts by weight, per 100 parts by weight of the polylactic acid from the standpoint of mechanical strength.

Examples of the benzoic acid compound mixed with the polylactic acid include benzoic acid, o-toluylic acid, m-toluylic acid, p-toluylic acid, p-t-butylbenzoic acid, p-t-amylbenzoic acid, p-t-octylbenzoic acid, o-methoxybenzoic acid, m-methoxybenzoic acid, anisic acid, benzoic anhydride, o-toluylic anhydride, m-toluylic anhydride, p-toluylic anhydride, p-t-butylbenzoic anhydride, p-t-amylbenzoic anhydride, p-t-octylbenzoic anhydride, o-methoxybenzoic anhydride, m-methoxybenzoic anhydride and anisic anhydride, and benzoic acid is most preferably used. The mixing ratio of the benzoic acid compound is generally from 1 to 10 parts by weight, and preferably from 2 to 6 parts by weight, per 100 parts by weight of the polylactic acid from the standpoint of mechanical strength.

The first component may further contain, in addition to the aliphatic polyester and the aliphatic polyester copolymer, for example, isophthalic acid, diphenylcarboxylic acid, naphthalenedicarboxylic acid, diphenyl ether dicarboxylic acid, diphenoxyethanedicarboxylic acid, diphenylethanedicarboxylic acid and the like, lower alkyl-substituted products thereof, lower alkoxy-substituted products thereof and halogen-substituted products thereof, and an aliphatic diol, such as butanediol and neopentyl glycol, in an amount of 10% by mol or less.

The fiber A of the invention may contain the first component solely, or may contain other component than the first component in such a range that the advantages of the invention are not impaired. The first component may contain two or more kinds of the aliphatic polyester or the aliphatic polyester copolymer.

The fiber B of the invention contains the second component having biodegradability. The fiber B may further contain other component having no biodegradability than the second component, and preferably contain only the second component having biodegradability. The second component may contain two or more kinds of components each having biodegradability. The second component preferably contains one kind or two or more kinds of an aliphatic polyester copolymer.

Examples of the aliphatic polyester copolymer include polyethylene succinate, polybutylene succinate, polyethylene terephthalate adipate, polyethylene terephthalate glutarate, polybutylene succinate adipate, polybutylene terephthalate adipate, polybutylene terephthalate glutarate and polycaprolactone.

These copolymers may be used solely or as a mixture of two or more kinds thereof. Among these, polybutylene succinate and polybutylene succinate adipate are preferred for enhancing the mechanical strength of the nonwoven fabric, which is produced by mixing with the first component fiber.

The second component may further contain, in addition to the aliphatic polyester copolymer, for example, isophthalic acid, diphenylcarboxylic acid, naphthalenedicarboxylic acid, diphenyl ether dicarboxylic acid, diphenoxyethanedicarboxylic acid, diphenylethanedicarboxylic acid and the like, lower alkyl-substituted products thereof, lower alkoxy-substituted products thereof and halogen-substituted products thereof, and an aliphatic diol, such as butanediol and neopentyl glycol, in an amount of 10% by mol or less.

A preferred embodiment of the aliphatic polyester copolymer used as the second component of the invention is an aliphatic polyester copolymer containing an aliphatic oxycarboxylic acid, an aliphatic or alicyclic diol, and an aliphatic dicarboxylic acid or a derivative thereof. Specific examples thereof include a copolymer that contains from 0.02 to 30% by mol of an aliphatic oxycarboxylic acid unit represented by the following formula (I), from 35 to 49.99% by mol of an aliphatic or alicyclic diol component represented by the following formula (II) (excluding an ethylene glycol unit), and from 35 to 49.99% by mol of an aliphatic dicarboxylic acid unit represented by the following formula (III), and has a number average molecular weight of from 10,000 to 200,000. In particular, polybutylene succinate having the aforementioned structure is preferred:

$$—O—R^1—CO— \quad (I)$$

wherein $R^1$ represents a divalent aliphatic hydrocarbon group, $$—O—R^2—O— \quad (II)$$

wherein $R^2$ represents a divalent aliphatic hydrocarbon group or a divalent alicyclic hydrocarbon group, and $$—O—R^3—CO— \quad (III)$$

wherein $R^3$ represents a single bond or a divalent aliphatic hydrocarbon group.

A preferred embodiment of the aforementioned aliphatic polyester copolymer that is preferred as the second component can be produced in such a manner that the aliphatic or alicyclic diol and the aliphatic dicarboxylic acid or a derivative thereof are reacted through polycondensation reaction in the presence of a catalyst to produce an aliphatic polyester copolymer having a number average molecular weight of from 10,000 to 200,000, in which the aliphatic oxycarboxylic acid is copolymerized in an amount of from 0.04 to 60 mol per 100 mol of the aliphatic carboxylic acid or a derivative thereof.

Upon producing the preferred embodiment of the aforementioned aliphatic polyester copolymer that is preferred as the second component, the aliphatic oxycarboxylic acid, which corresponds to the aliphatic oxycarboxylic acid unit represented by the formula (I), is not particularly limited as far as it is an aliphatic compound having one hydroxyl group and one carboxyl group in one molecule. Examples of the aliphatic oxycarboxylic acid include an aliphatic oxycarboxylic acid represented by the following formula (IV), and an aliphatic oxycarboxylic acid represented by the following formula (V) is particularly preferred since enhancement of the polymerization reactivity is observed with the compound:

$$HO—R^1—COOH \quad (IV)$$

wherein $R^1$ represents a divalent aliphatic hydrocarbon group, and $$HO—\underset{\underset{C_xH_{2x+1}}{|}}{CH}—COOH \quad (V)$$

wherein x represents an integer of from 0 to 10, and preferably from 0 to 5.

Specific examples of the aliphatic oxycarboxylic acid constituting the aliphatic polyester copolymer as a preferred embodiment of the second component include lactic acid, glycolic acid, 2-hydrox-n-butyric acid, 2-hydroxycaproic acid, 2-hydroxy-3,3-dimethylbutyric acid, 2-hydroxy-3-methylbutyric acid, 2-hydroxyisocaproic acid and mixtures thereof. These compounds each may be either a D-isomer, an L-isomer or a racemic substance when the compound has optical isomerism, and each may be in the form of solid, liquid or an aqueous solution. Among these, lactic acid and glycolic acid are preferred since the polymerization speed is significantly increased upon use. Lactic acid and glycolic acid are preferred since they are conveniently available in the form of an aqueous solution with a concentration of from 30 to 95%. The aliphatic oxycarboxylic acid may be used solely or as a mixture of two or more kinds thereof.

The diol corresponding to the aliphatic or alicyclic diol unit represented by the formula (II) is not particularly limited, and examples thereof include a diol represented by the following formula:

$$HO—R^2—OH$$

wherein $R^2$ represents a divalent aliphatic hydrocarbon group or a divalent alicyclic hydrocarbon group.

Preferred examples of the divalent aliphatic hydrocarbon group include an aliphatic hydrocarbon group represented by the following formula:

$$—(CH_2)_n—$$

wherein n represents an integer of from 2 to 10. Particularly preferred examples of the group represented by $R^2$ include an aliphatic hydrocarbon group having from 2 to 6 carbon atoms. Preferred examples of the divalent alicyclic hydrocarbon group include a divalent alicyclic hydrocarbon group having from 3 to 10 carbon atoms, and more preferably a divalent alicyclic hydrocarbon group having from 4 to 6 carbon atoms.

Specific preferred examples of the aliphatic or alicyclic diol represented by the formula (II) include ethylene glycol, trimethylene glycol, 1,3-propanediol, 1,4-butanediol, 1,5-pentanediol, 1,6-hexanediol, 1,4-cyclohexanediol and 1,4-cyclohexanedimethanol. Among these, 1,4-butanediol is particularly preferred from the standpoint of properties of the resulting aliphatic polyester copolymer used as the second component of the invention. The aliphatic or alicyclic diol may be used solely or as a mixture of two or more kinds thereof.

Examples of the aliphatic dicarboxylic acid or a derivative thereof corresponding to the aliphatic dicarboxylic acid unit represented by the formula (III) include a dicarboxylic acid represented by the following formula:

$$HOOC—R^3—COOH$$

wherein $R^3$ represents a single bond or a divalent aliphatic hydrocarbon group, and preferably $—(CH_2)_m—$, wherein m represents an integer of from 0 to 10, and preferably from 0 to 6.

Examples of the aliphatic dicarboxylic acid or a derivative thereof corresponding to the aliphatic dicarboxylic acid unit represented by the formula (III) also include an ester of the aliphatic dicarboxylic acid or a derivative thereof represented by the aforementioned formula with a lower alcohol having from 1 to 4 carbon atoms. Specific examples of the ester include a dimethyl ester, and examples of the derivative of the aliphatic dicarboxylic acid include an anhydride.

Specific examples of the aliphatic dicarboxylic acid or a derivative thereof corresponding to the aliphatic dicarboxylic acid unit represented by the formula (III) include oxalic acid, succinic acid, glutaric acid, adipic acid, sebacic acid, dodecanedioic acid, lower alcohol esters thereof, succinic anhydride and adipic anhydride. Among these, succinic acid, adipic acid and sebacic acid, anhydrides thereof, and lower alcohol esters thereof are preferred from the standpoint of properties of the resulting copolymer, and succinic acid, succinic anhydride and a mixture thereof are particularly preferred. These compounds may be used solely or as a mixture of two or more kinds thereof.

The aliphatic polyester copolymer containing the aliphatic oxycarboxylic acid, the aliphatic or alicyclic diol and the aliphatic dicarboxylic acid or a derivative thereof as a preferred embodiment of the second component may be produced by a known method. The polymerization reaction for producing the aliphatic polyester copolymer may be performed under the known conditions without any particular limitation.

The amount of the aliphatic or alicyclic diol used upon producing the aliphatic polyester copolymer as a preferred embodiment of the second component may be substantially equimolar to the amount of the aliphatic dicarboxylic acid or a derivative thereof used, and is preferably used excessively by from 1 to 20% by mol since the aliphatic or alicyclic diol generally remains in the ester. Upon producing the aliphatic polyester copolymer, the addition of the aliphatic oxycarboxylic acid in an excessive amount of 1% by mol or more provides sufficient effect of the addition thereof, and the addition thereof in an excessive amount of 20% by mol or less provides sufficient crystallinity maintained, which is preferred for molding, to provide good heat resistance and mechanical characteristics. The amount of the aliphatic oxycarboxylic acid upon producing the aliphatic polyester copolymer is preferably from 0.04 to 60 mol, preferably from 1.0 to 40 mol, and particularly preferably from 2 to 20 mol, per 100 mol of the aliphatic dicarboxylic acid or a derivative thereof.

The time and the method for adding the aliphatic oxycarboxylic acid upon producing the aliphatic polyester copolymer as a preferred embodiment of the second component are not particularly limited as far as it is added before performing the polycondensation reaction, and examples thereof include (1) a method of adding a solution of the aliphatic oxycarboxylic acid containing a catalyst having been dissolved therein, and (2) a method of adding the aliphatic oxycarboxylic acid simultaneously with a catalyst upon charging the raw materials.

The aliphatic polyester copolymer as a preferred embodiment of the second component is produced preferably in the presence of a polymerization catalyst. Preferred examples of the catalyst include a germanium compound. The germanium compound is not particularly limited, and examples thereof include an organic germanium compound, such as tetraalkoxygermanium, an inorganic germanium compound, such as germanium oxide and germanium chloride. Among these, germanium oxide, tetraethoxygermanium, tetrabutoxygermanium and the like are preferred from the standpoint of cost and availability, and germanium oxide is particularly preferred. Other catalysts than these compounds may be used in combination.

The amount of the catalyst used is preferably from 0.001 to 3% by weight, and more preferably from 0.005 to 1.5% by weight, based on the amount of the monomers used. The time for adding the catalyst is not particularly limited as far as the catalyst is added before performing the polycondensation reaction, and the catalyst is preferably added upon charging the raw materials and may be added upon starting reducing the pressure of the reaction system. Such a method is preferred that the catalyst is added simultaneously with the addition of the aliphatic oxycarboxylic acid, such as lactic acid and glycolic acid, or the catalyst is added after dissolving in an aqueous solution of the aliphatic oxycarboxylic acid, and such a method is particularly preferred that the catalyst is added after dissolving in the aliphatic oxycarboxylic acid aqueous solution since favorable preservability of the catalyst is obtained.

The aliphatic polyester copolymer as a preferred embodiment of the second component preferably has a number average molecular weight of from 10,000 to 200,000, and more preferably from 30,000 to 200,000.

Another copolymer component may be introduced to the aliphatic polyester copolymer. Examples of the copolymer component include an aromatic oxycarboxylic acid compound, such as hydroxybenzoic acid, an aromatic diol compound, such as bisphenol A, an aromatic dicarboxylic acid, such as terephthalic acid and isophthalic acid, a polyhydric alcohol, such as trimethylolpropane and glycerin, a polybasic carboxylic acid or an anhydride thereof, and a polybasic oxycarboxylic acid, such as malic acid.

The combination of the first component and the second component is not particularly limited as far as the first component contains an aliphatic polyester or an aliphatic polyester copolymer having a melting point that is higher than the melting point of the second component. Specific examples of the combination include combinations containing the aforementioned specific examples for the first component and the aforementioned specific examples for the second component. Among these combinations, preferred examples of the combination (first component/second component) include polylactic acid/polybutylene succinate, polyethylene succinate glutarate/polybutylene succinate, polylactic acid/polybutylene succinate adipate, polylactic acid/polyethylene succinate, and polyethylene succinate glutarate/polyethylene succinate, and particularly preferred examples thereof (first component/second component) include polylactic acid/polybutylene succinate and polylactic acid/polybutylene succinate adipate.

The aliphatic polyester or the aliphatic polyester copolymer that are preferably used in the first component and the second component contained in the biodegradable nonwoven fabric of the invention may contain, depending on necessity, additives, such as an antioxidant, a light stabilizer, an ultraviolet ray absorbent, a neutralizing agent, a nucleating agent, an epoxy stabilizer, a lubricant, an antibacterial agent, a flame retardant, an antistatic agent, a pigment, a plasticizer and a hydrophilic agent.

The melt mass-flow rates (abbreviated as MFR, measured under the condition D (temperature: 190 degree Celsius, load: 2.16 kg) defined in JIS K7210, Appendix A, Table 1) of the first component and the second component contained in the biodegradable nonwoven fabric of the invention before spinning are not particularly limited as far as they are each MFR capable of performing a spinning operation, and is preferably in a range of from 1 to 200 g per 10 minutes, and more preferably from 10 to 200 g per 10 minutes. In a melt-blown method, which is one embodiment of the invention, the MFR is preferably higher for forming fine filaments, and is preferably from 20 to 200 g per 10 minutes.

It is important in the biodegradable nonwoven fabric of the invention that the half crystallization time of the first component is differentiated from that of the second component, and the second component has a longer half crystallization time. The reasons of the constitution will be described below.

In the case where a component having biodegradability (i.e., a biodegradable resin), such as those used as the first and second components of the invention, is spun as a major component into fibers and formed into a web, and the biodegradable resin has a high melting point, a floc-like web can be formed, but sufficient mechanical strength cannot be obtained due to insufficient adhesion at the contact points of the fibers in the web, and it is necessary to perform heat treatment for enhancing the adhesion of the fibers. In this case, the fibers are adhered, but the entire web becomes hard due to solidification and crystallization of the resin upon adhesion, which results in a nonwoven fabric with hard texture. In the case where a biodegradable resin having a relatively low melting point is used, a web formed therefrom has tackiness to make handling, such as conveying and winding, thereof difficult. Even though tackiness is not formed, the fibers are excessively adhered to negate the subsequent heat treatment, and if the heat treatment is performed, the resulting nonwoven fabric has further harder texture. In the case where a web is formed by a melt-blown method or a spunbond method, the same problems as above occur when the fibers are collected on the conveyer.

The case where two kinds of biodegradable resins having different melting points are spun and mixed will be described. In the case where there is substantially no difference in crystallization (solidification) time between the two kinds of resin, or in the case where the crystallization (solidification) time of the resin having the higher melting point is longer, the behaviors of the biodegradable resins upon crystallization (solidification) are the same as the above case where single kind fibers are spun, and the problems associated therewith are not solved even though the resins have different melting points. For solving the problems, it is important to consider the solidification times of the biodegradable resins. The relative crystallization (solidification) times of the biodegradable resins can be comprehended by measuring the half crystallization times of the resins.

In the invention, accordingly, the first component and the second component contained in the biodegradable nonwoven fabric are selected to provide a difference in half crystallization time, whereby the half crystallization time of the second component is longer than that of the first component. According to the constitution, the biodegradable resin having a shorter half crystallization time retains the texture of the nonwoven fabric, and the biodegradable resin having a longer half crystallization time forms tangle-connecting points required for forming the nonwoven fabric, thereby providing a biodegradable nonwoven fabric excellent in texture and mechanical strength. The first component and the second component may be biodegradable resins different from each other or may be the similar biodegradable resin as far as the resins satisfy the aforementioned conditions.

More specifically, the first component and the second component are preferably selected in such a manner that the half crystallization time of the second component is longer than the half crystallization time of the first component by 80 seconds or more, whereby the second component is crystallized after completing crystallization of the first component upon forming the nonwoven fabric, and thus the problems upon conveying and winding are reduced. It is preferred that the half crystallization time of the second component is longer than the half crystallization time of the first component by 100 seconds or more, more preferably 120 second or more, and further preferably 150 seconds or more.

It is preferred that the half crystallization time of the second component is 180 seconds or more, and the half crystallization time of the first component is 100 seconds or less, whereby the problems upon conveying and winding after producing the nonwoven fabric are reduced.

The half crystallization time of the first component is preferably 60 seconds or less, and more preferably 30 seconds or less. According to the constitution, even when the second component as an adhesive component is present in the nonwoven fabric, the problems upon conveying and winding due to adhesiveness after producing the nonwoven fabric by a hot air treatment, a point heat compression treatment or the like can be reduced. In the melt-blown method, particularly, in the case where the first component and the second component having the aforementioned half crystallization times are used for forming a mixed fiber web on a collecting conveyer, the second component fibers are collected in an uncrystallized state, thereby providing a nonwoven fabric having tangle-connecting points formed between the fibers. On the other hand, the first component is collected in a crystallized state to form no tangle-connecting point with the fibers, thereby providing a web with good texture. Consequently, the first component maintains the texture, and the second component forms tangle-connecting points with the fibers that are required for forming a nonwoven fabric, thereby providing a nonwoven fabric excellent in both texture and mechanical strength.

Various properties including texture, flexibility, heat resistance and the like can be imparted to the biodegradable nonwoven fabric of the invention by selecting the combination of the first component and the second component contained in the biodegradable nonwoven fabric.

In the case where the difference in melting point between the first component and the second component is a certain value or larger, the heat adhesion property and the tensile strength of the mixed fibers can be maintained favorably. Accordingly, the difference in melting point between the first component and the second component is preferably 20 degree Celsius or more, and more preferably 40 degree Celsius or more.

In the biodegradable nonwoven fabric of the invention, when the mixing ratio of the fiber A is too small, the resulting nonwoven fabric is insufficient in flexibility and texture, and when the ratio of the fiber A is too large, the resulting nonwoven fabric is decreased in strength. In view of the standpoint, the mixing ratio (weight ratio) of the fiber A and the fiber B is preferably from 5/95 to 95/5, more preferably from 10/90 to 90/10, and particularly preferably from 20/80 to 80/20. Using the fiber A and the fiber B as a mixed fiber as in the invention, it facilitates spinning of components that are low in dissolubility to each other and difficult to spin as mixed resins therewith.

The method for producing the fibers constituting the biodegradable nonwoven fabric of the invention is not particularly limited, and examples thereof include a method of providing short fibers, such as staple fibers and chopping, and a method of providing continuous fibers, such as a melt-blown method, a spunbond method and a tow filamentization method. Among these, a melt-blown method is preferred when the texture is particularly important, and a spunbond method is preferred when the strength is particularly important.

In the biodegradable nonwoven fabric of the invention, the method for combining the fiber A and the fiber B is not particularly limited, and a known method may be employed.

For example, the spun and stretched fibers are subjected to a crimping treatment and cut into a prescribed length to provide short fibers of the fiber A and the fiber B, and the both fibers are mixed upon forming a web by a carding method or an air raid method. Upon blowing fibers onto the collecting conveyer in the process of directly forming a nonwoven fabric of one kind of the fibers by a melt-blown method or a spunbond method, short fibers or continuous fibers of the other kind of the fibers may be fed to the collecting conveyer to mix the fibers. Alternatively, continuous fibers produced by a melt-blown method or a spunbond method may be blown upon forming a web with short fibers or continuous fibers.

In the case where the fibers A and B constituting the biodegradable nonwoven fabric of the invention are formed by a spunbond method, for example, a spinning die disclosed in Japanese Patent No. 3,360,377 may be employed, in which one spinning die has rows of spinning holes, from which different kinds of resins are discharged respectively, aligned alternately. A web obtained by using the spinning die contains the fibers A and B that are uniformly mixed. Alternatively, for example, a spinning die for the fiber A and a spinning die for the fiber B are used in combination, and a web of the fiber A and a web of the fiber B, which are obtained with the spinning dies respectively, are laminated. Furthermore, the laminated product may be subjected to a needle-punching treatment or the like to improve the mixed state of fibers. The spinning die disclosed in Japanese Patent No. 3,360,377 is preferably employed for providing a web with a more uniform mixed state.

The contents of the respective fibers in the biodegradable nonwoven fabric can be controlled by changing the numbers of the spinning holes assigned to the fiber A and the fiber B or by changing the discharging amounts of the fibers from the spinning holes. Mixtures with different finenesses can be provided by spinning the resins with different extruding amounts per spinning hole or spinning with a die having different hole diameters for the resins.

In the case where the fibers A and B constituting the biodegradable nonwoven fabric of the invention are formed by a spunbond method, for example, a spinning die may be used for melt spinning, in which spinning holes, from which different resins are discharged respectively, are arranged in a staggered form in one spinning die. A web obtained by using the spinning die contains the fibers A and B that are more uniformly mixed. Alternatively, for example, a spinning die for the fiber A and a spinning die for the fiber B are used in combination, and a web of the fiber A and a web of the fiber B, which are obtained with the spinning dies respectively, are laminated. Furthermore, the laminated product may be subjected to a needle-punching treatment or the like to improve the mixed state of the fibers.

The cross sectional shape of the fibers constituting the biodegradable nonwoven fabric of the invention may be a circular cross sectional shape, or may be an irregular cross sectional shape or a hollow cross sectional shape unless the spinning operation is impaired. The average fiber diameter of the fibers is not particularly limited and is preferably in a range of from 1 to 50 mm, and is more preferably in a range of from 1 to 30 mm from the standpoint of texture.

The weight per unit area (Metsuke) of the biodegradable nonwoven fabric of the invention is not particularly limited, and is preferably from 1 to 300 g/m$^2$, more preferably from 5 to 200 g/m$^2$, and further preferably from 10 to 150 g/m$^2$. The biodegradable nonwoven fabric may be subjected to a heat treatment depending on necessity. Examples of the method for the heat treatment include known methods, such as a heat pressing method with a flat calender roll or an embossed heat roll, an air-through method by heating with air, and a method using an infrared ray lamp. One or more of the treatments including a sonic bond process, a water jet process, a steam jet process, a needle punch process and a resin bond process may be performed.

In the invention, the resulting biodegradable nonwoven fabric may be laminated with at least one member selected from a nonwoven fabric other than the biodegradable nonwoven fabric, a film, a web, a woven fabric, a knitted fabric and a tow to form a composite nonwoven fabric. The material to be laminated is not particularly limited, and various materials may be selected appropriately depending on the purposes.

Description of Embodiments

The invention will be described in more detail with reference to examples below, but the invention is not limited to the examples.

The measurement methods employed in the examples will be described.

(1) Half Crystallization Time

By using a thermal analyzer, DSC Q10, a trade name, available from TA Instruments, Inc., 4 mg of a specimen was heated and melted at a temperature increasing rate of 10 degree Celsius per minute, and the temperature was decreased at a temperature decreasing rate of 10 degree Celsius per minute to a set temperature of 85 degree Celsius for crystallizing the specimen. The point where DHc was ½ was read from the thermograph in the crystallization process, and the period of time (second) from the point where the crystallization started to the point where DHc was ½ was measured. The measurement was performed repeatedly three times, and the average value obtained therefrom was designated as the half crystallization time.

(2) Melting Point

By using a thermal analyzer, DSC Q10, a trade name, available from TA Instruments, Inc., a specimen was measured for melting point according to JIS K7122 at a temperature increasing rate of 10 degree Celsius per minute.

(3) Tensile Strength

A nonwoven fabric cut into a strip form with a dimension of 25 mm in width and 150 mm in length was used as a specimen, which was measured for breaking strength and breaking elongation in the machine direction (MD) and the crosswise direction (CD, the direction perpendicular to the machine direction) by using Autograph AG-G, a trade name, available from Shimadzu Corporation. The test conditions were room temperature, a tensile speed of 100 mm/min, and a test length of 100 mm.

(4) Flexibility

A specimen was measured for bending resistance in MD of the nonwoven fabric according to JIS L1096 (the method A, 45 degree Celsiusantilever method), and the result was designated as flexibility. A smaller value for flexibility means that the nonwoven fabric is softer.

(5) Texture of Nonwoven Fabric

A nonwoven fabric was touched by ten subjects for determining the texture. The determination standard was as follows. The case where all the subjects determined that the nonwoven fabric was soft without rough feeling was evaluated as "excellent" (A), the case where three or four subjects determined similarly was evaluated as "good" (B), and the case where three or more subjects determined that rough feeling was found or soft feeling was not found was evaluated as "poor" (C).

(6) Evaluation of Biodegradability

A nonwoven fabric was buried in the soil for six months and then taken out therefrom. The case where the nonwoven fabric lost its shape, and the tensile strength after burying was not able to be measured was evaluated as "excellent" (A), the case where the nonwoven fabric maintained it shape, but the tensile strength thereof after burying was decreased to less than 50% of the tensile strength before burying was evaluated as "good" (B), and the case where the tensile strength of the nonwoven fabric after burying was 50% or more of the tensile strength before burying was evaluated as "poor" (C).

(7) Determination of Mechanical Strength of Nonwoven Fabric

For determining the mechanical strength of a nonwoven fabric, the behavior of the nonwoven fabric upon breaking in the measurement of tensile strength was visually observed. The case where the nonwoven fabric was broken while maintaining the shape of the nonwoven fabric was evaluated as "excellent" (A), and the case where the nonwoven fabric was broken in the form of web was evaluated as "poor" (C).

(8) Releasing Property from Collecting Conveyer

The releasing property of a nonwoven fabric from the collecting conveyer upon producing the nonwoven fabric was visually observed. The nonwoven fabric was favorably released from the collecting conveyer was evaluated as "excellent" (A), and the case where the nonwoven fabric was not smoothly released from the collecting conveyer due to adhesion or agglutination was evaluated as "poor" (C).

The materials used in the examples and symbols therefor are as follows.

PLA-1: polylactic acid (U'z S-22, a trade name, available from Toyota Motor Corporation, melting point: 174 degree Celsius, MFR: 20, condition: D)

PLA-2: polylactic acid (6201D, a trade name, available from Nature Works LLC, melting point: 166 degree Celsius, MFR: 13.5, condition: D)

PLA-3: polylactic acid (6252D, a trade name, available from Nature Works LLC, melting point: 165 degree Celsius, MFR: 36, condition: D)

PBS-1: polybutylene succinate (GSP1a AZ71T, a trade name, available from Mitsubishi Chemical Corporation, melting point: 110 degree Celsius, MFR: 20, condition: D)

PBS-2: polybutylene succinate (GSP1a AZ61T, a trade name, available from Mitsubishi Chemical Corporation, melting point: 110 degree Celsius, MFR: 30, condition: D)

PBS-3: polybutylene succinate (Bionolle 1050, a trade name, available from Showa Highpolymer Co., Ltd., melting point: 114 degree Celsius, MFR: 55, condition: D)

PBSA: polybutylene succinate adipate (Bionolle 3020, a trade name, available from Showa Highpolymer Co., Ltd., melting point: 104 degree Celsius, MFR: 30, condition: D)

PES: polyethylene succinate (Lunare SE, a trade name, available from Nippon Shokubai Co., Ltd., melting point: 102 degree Celsius, MFR: 28, condition: D)

PETG: polyethylene terephthalate glutarate (Biomax 4026, a trade name, available from E.I. du Pont Company, melting point: 199 degree Celsius, MFR: 22, condition: D)

PBTA: polybutylene terephthalate adipate (EASTAR BIO GP, a trade name, available from Eastman Chemical Company, melting point: 108 degree Celsius, MFR: 28, condition: D)

EXAMPLE 1

As the raw material resins, PLA-1 was used as the first component, and PBS-1 was used as the second component. As a melt-blown apparatus, such an apparatus was used that contained a screw (diameter: 30 mm), two extruders each having a heating element and a gear pump, a spinning die for mixed fiber (a hole diameter: 0.3 mm, rows of spinning holes for discharging fibers of different components respectively aligned alternately, number of holes: 501, effective width: 500 mm), a compressed air generating device, an air heating device, a collecting conveyer equipped with a polyester net, and a winding device. PLA1 and PBS-1 were placed separately in the extruders and were each heated and melted at 230 degree Celsius with the heating elements. PLA-1 and PBS-1 were each discharged from the spinning die at a spinning speed of 0.45 g/min per one spinning hole for both PLA-1 and PBS-1 while setting the gear pump to make a ratio of PLA-1/PBS-1 (% by weight) of 50/50, and the thus discharged fibers were blown with compressed air of 98 kPa (gauge pressure) heated to 400 degree Celsius onto the collecting conveyer equipped with a polyester net running at a speed of 22 m/min, thereby providing a melt-blown nonwoven fabric containing fibers formed of PLA-1 and fibers formed of PBS-1 that are accumulated uniformly and randomly. The collecting conveyer was disposed at a position with a distance of 25 cm from the spinning die. The air thus blown was removed with an aspiration device disposed on the backside of the collecting conveyer. The properties of the nonwoven fabric thus obtained are shown in Table 1. The resulting biodegradable nonwoven fabric had excellent characteristics for mechanical strength and flexibility.

EXAMPLE 2

A biodegradable nonwoven fabric was produced in the same manner as in Example 1 except that PLA-1 was used as the first component, and PBS-2 was used as the second component. The properties of the nonwoven fabric thus obtained are shown in Table 1. The resulting biodegradable nonwoven fabric had excellent characteristics for mechanical strength and flexibility.

EXAMPLE 3

A biodegradable nonwoven fabric was produced in the same manner as in Example 1 except that PLA-2 was used as the first component, and PBS-1 was used as the second component. The properties of the nonwoven fabric thus obtained are shown in Table 1. The resulting biodegradable nonwoven fabric had excellent characteristics for mechanical strength and flexibility.

EXAMPLE 4

A biodegradable nonwoven fabric was produced in the same manner as in Example 1 except that PLA-3 was used as the first component, and PBS-3 was used as the second component. The properties of the nonwoven fabric thus obtained are shown in Table 1. The resulting biodegradable nonwoven fabric had excellent characteristics for mechanical strength and flexibility.

EXAMPLE 5

A biodegradable nonwoven fabric was produced in the same manner as in Example 1 except that PLA-1 was used as the first component, and PBSA was used as the second component. The properties of the nonwoven fabric thus obtained are shown in Table 1. The resulting biodegradable nonwoven fabric had excellent characteristics for mechanical strength and flexibility.

EXAMPLE 6

A biodegradable nonwoven fabric was produced in the same manner as in Example 1 except that PLA-1 was used as the first component, and PBS-1 was used as the second component, and PLA-1 and PBS-1 were each discharged from the spinning die at a spinning speed of 0.45 g/min per one spinning hole for both PLA-1 and PBS-1 while setting the gear pump to make a ratio of PLA-1/PBS-1 (% by weight) of 70/30. The properties of the nonwoven fabric thus obtained are shown in Table 1. The resulting biodegradable nonwoven fabric had excellent characteristics for mechanical strength and flexibility.

EXAMPLE 7

A biodegradable nonwoven fabric was produced in the same manner as in Example 1 except that PLA-1 was used as the first component, and PBS-1 was used as the second component, and PLA-1 and PBS-1 were each discharged from the spinning die at a spinning speed of 0.45 g/min per one spinning hole for both PLA-1 and PBS-1 while setting the gear pump to make a ratio of PLA-1/PBS-1 (% by weight) of 30/70. The properties of the nonwoven fabric thus obtained are shown in Table 2. The resulting biodegradable nonwoven fabric had excellent characteristics for mechanical strength and flexibility.

EXAMPLE 8

A biodegradable nonwoven fabric was produced in the same manner as in Example 1 except that PLA-1 was used as the first component, and PBS-1 was used as the second component, and PLA-1 and PBS-1 were each discharged from the spinning die at a spinning speed of 0.45 g/min per one spinning hole for both PLA-1 and PBS-1 while setting the gear pump to make a ratio of PLA-1/PBS-1 (% by weight) of 60/40. The properties of the nonwoven fabric thus obtained are shown in Table 2. The resulting biodegradable nonwoven fabric had excellent characteristics for mechanical strength and flexibility.

EXAMPLE 9

A biodegradable nonwoven fabric was produced in the same manner as in Example 1 except that PLA-1 was used as the first component, and PES was used as the second component. The properties of the nonwoven fabric thus obtained are shown in Table 2. The resulting biodegradable nonwoven fabric had excellent characteristics for mechanical strength and flexibility.

EXAMPLE 10

A biodegradable nonwoven fabric was produced in the same manner as in Example 1 except that PETG was used as the first component, and PBS-1 was used as the second component. The properties of the nonwoven fabric thus obtained are shown in Table 2. The resulting biodegradable nonwoven fabric had excellent characteristics for mechanical strength and flexibility.

EXAMPLE 11

As the raw material resins, PLA-1 was used as the first component, and PBS-1 was used as the second component. As a spunbond apparatus, such an apparatus was used that contained a screw (diameter: 30 mm), two extruders each having a heating element and a gear pump, a spinning die for mixed fiber (a hole diameter: 0.4 mm, number of holes: 120), an air sucker, a charge filamentization device, a collecting conveyer equipped with a polyester net, a point bond processing device, and a winding device. PLA-1 and PBS-1 were placed separately in the extruders and were each heated and melted at 230 degree Celsius with the heating elements. PLA-1 and PBS-1 were each discharged from the spinning die at a spinning speed of 0.45 g/min per one spinning hole for both PLA-1 and PBS-1 while setting the gear pump to make a ratio of PLA-1/PBS-1 (% by weight) of 50/50, and the thus discharged fibers were introduced to the air sucker and then immediately filamentized with the charge filamentization device, followed by collecting onto the collecting conveyer. The air pressure of the air sucker was 196 kPa. The web on the collecting conveyer was placed into the point bond processing device (pressing area: 21%) with vertical rolls heated to 60 degree Celsius, and the nonwoven fabric thus processed was wound into a roll form with the winding device, thereby providing a spunbond nonwoven fabric. The properties of the nonwoven fabric thus obtained are shown in Table 2. The resulting biodegradable nonwoven fabric had excellent characteristics for mechanical strength and flexibility.

EXAMPLE 12

A biodegradable nonwoven fabric was produced in the same manner as in Example 1 except that PLA-1 was used as the first component, and PBTA was used as the second component. The properties of the nonwoven fabric thus obtained are shown in Table 2. The resulting biodegradable nonwoven fabric had excellent characteristics for mechanical strength and flexibility.

COMPARATIVE EXAMPLE 1

A biodegradable nonwoven fabric was produced in the same manner as in Example 1 except that PLA-1 was used as the first component, and PLA-1 was used as the second component. The properties of the nonwoven fabric thus obtained are shown in Table 3. The resulting biodegradable nonwoven fabric was in the form of web without a connecting point by heat adhesion, and failed to provide sufficient mechanical strength.

COMPARATIVE EXAMPLE 2

A biodegradable nonwoven fabric was produced in the same manner as in Example 1 except that PBS-1 was used as the first component, and PBS-1 was used as the second component. The properties of the nonwoven fabric thus obtained are shown in Table 3. The resulting biodegradable nonwoven fabric was poor in releasing property from the collecting conveyer, and failed to provide sufficient capability due to poor flexibility and texture.

COMPARATIVE EXAMPLE 3

A biodegradable nonwoven fabric was produced in the same manner as in Example 1 except that PLA-1 was used as the first component, and PLA-3 was used as the second component. The properties of the nonwoven fabric thus obtained are shown in Table 3. The resulting biodegradable nonwoven fabric was in the form of web without a connecting point by heat adhesion, and failed to provide sufficient mechanical strength.

COMPARATIVE EXAMPLE 4

A biodegradable nonwoven fabric was produced in the same manner as in Example 1 except that PBS-1 was used as the first component, and PBS-3 was used as the second component. The properties of the nonwoven fabric thus obtained are shown in Table 3. The resulting biodegradable nonwoven fabric was poor in releasing property from the collecting conveyer, and failed to provide sufficient capability due to poor flexibility and texture.

TABLE 1

| | Example 1 | Example 2 | Example 3 | Example 4 | Example 5 | Example 6 |
|---|---|---|---|---|---|---|
| Raw material resin: | | | | | | |
| Resin for first component | PLA-1 | PLA-1 | PLA-2 | PLA-3 | PLA-1 | PLA-1 |
| Half crystallization time (sec) | 16 | 16 | 14 | 21 | 16 | 16 |
| Melting point (° C.) | 174 | 174 | 166 | 165 | 174 | 174 |
| MFR (g per 10 min) | 20 | 20 | 13.5 | 36 | 20 | 20 |
| Raw material resin: | | | | | | |
| Resin for second component | PBS-1 | PBS-2 | PBS-1 | PBS-3 | PBSA | PBS-1 |
| Half crystallization time (sec) | 197 | 201 | 197 | 212 | 242 | 197 |
| Melting point (° C.) | 110 | 110 | 110 | 114 | 104 | 110 |
| MFR (g per 10 min) | 20 | 30 | 20 | 55 | 30 | 20 |
| Mixing ratio (by weight) first component/second component | 50/50 | 50/50 | 50/50 | 50/50 | 50/50 | 70/30 |
| Production method | melt-blown | melt-blown | melt-blown | melt-blown | melt-blown | melt-blown |
| Average fiber diameter (μm) | 10 | 8 | 13 | 5 | 7 | 10 |
| Weight per unit area (Metsuke) ($g/m^2$) | 21 | 20 | 20 | 21 | 22 | 20 |
| Thickness (mm) | 0.35 | 0.31 | 0.30 | 0.28 | 0.26 | 0.42 |
| Tensile strength (N per 25 mm) | 2.7 | 2.7 | 2.5 | 2.4 | 2.2 | 3.0 |
| Tensile elongation (%) | 14 | 15 | 15 | 16 | 14 | 18 |
| Flexibility (mm) | 52 | 55 | 55 | 51 | 53 | 48 |
| Evaluation of texture | A | A | A | A | A | A |
| Biodegradation capability | A | A | A | A | A | A |
| Mechanical strength | A | A | A | A | A | A |
| Releasing property from collecting conveyer | A | A | A | A | A | A |

TABLE 2

| | Example 7 | Example 8 | Example 9 | Example 10 | Example 11 | Example 12 |
|---|---|---|---|---|---|---|
| Raw material resin: | | | | | | |
| Resin for first component | PLA-1 | PLA-1 | PLA-1 | PETG | PLA-1 | PLA-1 |
| Half crystallization time (sec) | 16 | 16 | 16 | 6 | 16 | 16 |
| Melting point (° C.) | 174 | 174 | 174 | 199 | 174 | 174 |
| MFR (g per 10 min) | 20 | 20 | 20 | 22 | 20 | 20 |
| Raw material resin: | | | | | | |
| Resin for second component | PBS-1 | PBS-1 | PES | PBS-1 | PBS-1 | PBTA |
| Half crystallization time (sec) | 197 | 197 | 221 | 197 | 197 | 66 |
| Melting point (° C.) | 110 | 110 | 102 | 110 | 110 | 108 |
| MFR (g per 10 min) | 20 | 20 | 28 | 20 | 20 | 28 |
| Mixing ratio (by weight) first component/second component | 30/70 | 60/40 | 50/50 | 50/50 | 50/50 | 50/50 |
| Production method | melt-blown | melt-blown | melt-blown | melt-blown | spunbond | melt-blown |
| Average fiber diameter (μm) | 10 | 10 | 8 | 8 | 17.5 | 7 |
| Weight per unit area (Metsuke) ($g/m^2$) | 21 | 20 | 20 | 20 | 20 | 20 |
| Thickness (mm) | 0.29 | 0.37 | 0.30 | 0.34 | 0.21 | 0.32 |
| Tensile strength (N per 25 mm) | 2.1 | 2.6 | 2.1 | 2.2 | 10.5 | 2.1 |
| Tensile elongation (%) | 15 | 15 | 15 | 14 | 20 | 12 |
| Flexibility (mm) | 61 | 50 | 52 | 54 | 55 | 57 |
| Evaluation of texture | B | A | A | A | A | A |

TABLE 2-continued

| | Example 7 | Example 8 | Example 9 | Example 10 | Example 11 | Example 12 |
|---|---|---|---|---|---|---|
| Biodegradation capability | A | A | A | B | A | A |
| Mechanical strength | A | A | A | A | A | A |
| Releasing property from collecting conveyer | A | A | A | A | A | A |

TABLE 3

| | Comparative Example 1 | Comparative Example 2 | Comparative Example 3 | Comparative Example 4 |
|---|---|---|---|---|
| Raw material resin: | | | | |
| Resin for first component | PLA-1 | PBS-1 | PLA-1 | PBS-1 |
| Half crystallization time (sec) | 16 | 197 | 16 | 197 |
| Melting point (° C.) | 174 | 110 | 174 | 110 |
| MFR (g per 10 min) | 20 | 20 | 20 | 20 |
| Raw material resin: | | | | |
| Resin for second component | PLA-1 | PBS-1 | PLA-3 | PBS-3 |
| Half crystallization time (sec) | 16 | 197 | 21 | 212 |
| Melting point (° C.) | 174 | 110 | 165 | 114 |
| MFR (g per 10 min) | 20 | 20 | 36 | 55 |
| Mixing ratio (by weight) first component/second component | 50/50 | 50/50 | 50/50 | 50/50 |
| Production method | melt-blown | melt-blown | melt-blown | melt-blown |
| Average fiber diameter (μm) | 13 | 7 | 14 | 4 |
| Weight per unit area (Metsuke) ($g/m^2$) | 20 | 20 | 20 | 20 |
| Thickness (mm) | 0.60 | 0.21 | 0.54 | 0.20 |
| Tensile strength (N per 25 mm) | — | 1.1 | — | 1.4 |
| Tensile elongation (%) | — | 12 | — | 11 |
| Flexibility (mm) | — | 85 | — | 83 |
| Evaluation of texture | B | C | B | C |
| Biodegradation capability | A | A | A | A |
| Mechanical strength | C | A | C | A |
| Releasing property from collecting conveyer | A | C | A | C |

INDUSTRIAL APPLICABILITY

Examples of a fiber product containing the biodegradable nonwoven fabric of the invention or the composite nonwoven fabric containing biodegradable nonwoven fabric of the invention include a sanitary material, a medical material, an architectural material, a household material, a clothing material, a packaging material, a food material and other various applications. The fiber product can be used in combination with various materials, such as a fabric, a film, a metallic net, a building material, a civil engineering material and an agricultural material.

Specific examples of the applications include a sanitary material, such as a surface material for a disposable diaper, a material for a diaper, a material for a sanitary napkin and a material for a diaper cover, an interlining cloth for clothing, an electrical insulating material and a thermal insulating material for clothing, a protective clothing, a hat and a cap, a face guard mask, gloves, an athletic supporter, a vibration absorbing material, a finger stall, a filter, such as an air filter for clean room, a blood filter and an oil/water separation filter, an electret filter subjected to electret treatment, a separator, a thermal insulator, a coffee bag, a food packaging material, a material for automobile, such as a surface material for automobile ceiling, an acoustic insulating material, a base material, a cushioning material, a dust preventing material for speaker, an air cleaner material, a surface material for insulator, a backing material and a door trim material, a cleaning material, such as a cleaning material for duplicator, a surface material and a backing material for carpet, an agricultural wound cloth, a wood draining material, a material for shoes, such as surface material for sport-shoes, a material for bag, an industrial sealing material, a wiping material and a sheet, but the invention is not limited to these materials.

The invention claimed is:

1. A biodegradable nonwoven fabric, which is a mixed fiber nonwoven fabric comprising at least two kinds of fibers that are mixed including a fiber A and a fiber B, wherein the fiber A contains a first component having biodegradability, wherein the fiber B contains a second component having biodegradability, wherein:

(a) the biodegradable nonwoven fabric comprises a mixed fiber web having a mixing ratio (weight ratio) of the fiber A and the fiber B in a range of from 20/80 to 80/20, (b) the first component comprises at least one member selected from the group consisting of an aliphatic polyester and an aliphatic polyester copolymer each having a melting point that is higher than a melting point of the second component, and (c) a half crystallization time at 85° C. of the second component is 180 seconds or more, a half crystallization time at 85° C. of the first component is 60 seconds or less, and the half crystallization time at 85° C. of the second component is longer than the half crystallization time at 85°°C. of the first component by 80 seconds or more, and wherein the tensile strength of the biodegradable nonwoven fabric is between 2.1 and 3.0 N per 25 mm.

2. The biodegradable nonwoven fabric according to claim 1, wherein the first component contains at least one member selected from the group consisting of polylactic acid and a polylactic acid copolymer, and the second component contains at least one member selected from the group consisting of polybutylene succinate and a polybutylene succinate copolymer.

3. The biodegradable nonwoven fabric according to claim 1, wherein the first component has a melting point that is higher than a melting point of the second component by 40° C. or more.

4. A composite nonwoven fabric comprising the biodegradable nonwoven fabric according to claim 1, and at least one member selected from the group consisting of a nonwoven fabric other than the biodegradable nonwoven fabric, a film, a web, a woven fabric, a knitted fabric and a tow, that is laminated on the biodegradable nonwoven fabric.

5. A fiber product comprising the biodegradable nonwoven fabric according to claim 1.

6. A fiber product comprising the composite nonwoven fabric according to claim 4.

7. The biodegradable nonwoven fabric according to claim 1, wherein the fiber A consists of a first component having biodegradability, and wherein the fiber B consist of a second component having biodegradability.

8. The biodegradable nonwoven fabric according to claim 1, wherein the first component having biodegradability is a polylactic acid or polyethylene terephthalate glutarate having a melting point between 165 and 174° C. and a melt mass-flow rate between 13.5 and 36 as measured under the condition D defined JIS K7210, and wherein the second component having biodegradability is a polybutylene succinate, polybutylene succinate adipate, polyethylene succinate, or polybutylene terephthalate adipate having a melting point between 102 and 110° C. and a melt mass-flow rate between 20 and 55 as measured under the condition D defined in JIS K7210.

* * * * *